United States Patent [19]

Uriarte del Rio et al.

[11] 4,254,570

[45] Mar. 10, 1981

[54] DOUBLE BARRELLED FIREARM

[76] Inventors: Juan Uriarte del Rio, 78-Calle Bristol; Jose Jimenez-Alfaro, 33-Avda. Brasilia, both of Madrid 28, Spain

[21] Appl. No.: 953,496

[22] Filed: Oct. 23, 1978

[30] Foreign Application Priority Data

Oct. 22, 1977 [ES] Spain ..... 463.479
Mar. 27, 1978 [DE] Fed. Rep. of Germany ..... 2811760

[51] Int. Cl.[3] ..... F41C 3/00

[52] U.S. Cl. ..... 42/2; 42/14; 42/69 A

[58] Field of Search ..... 42/2, 1 M, 1 J, 1 Z, 42/1 H, 1 G, 14, 16, 69 A

[56] References Cited

U.S. PATENT DOCUMENTS

| | | | |
|---|---|---|---|
| 626,472 | 6/1899 | White | 42/1 J |
| 1,741,902 | 12/1929 | Alden | 42/1 G |
| 3,270,455 | 9/1966 | Smernoff et al. | 42/1 Z |
| 3,609,901 | 10/1971 | Necas | 42/1 M |

*Primary Examiner*—Charles T. Jordan
*Attorney, Agent, or Firm*—Wenderoth, Lind & Ponack

[57] ABSTRACT

A double barrelled firearm includes first and second parallel barrels attached to a casing which includes a pair of spaced parallel arms. A firing lever is pivotable about a bearing extending between the spaced arms from a first non-firing position to second firing positions successively inwardly of the casing. A bolt is slidably mounted on the casing at a location rearwardly of the barrels. The bolt has first and second firing pins aligned with the first and second barrels. The first and second firing pins have extending therefrom respective first and second stops of different lengths. The first and second firing pins are urged toward the first and second barrels respectively. The firing lever has on a first end thereof a guard which, when the firing lever is in the first non-firing position thereof, acts on the first and second stops to maintain the first and second firing pins spaced from the first and second barrels, against the force of the urging means. When the firing lever is sequentially moved to the second firing positions, the guard sequentially releases the first and second stops and thereby allows the urging means to sequentially drive the first and second firing pins toward the first and second barrels.

5 Claims, 5 Drawing Figures

DOUBLE BARRELLED FIREARM

BACKGROUND AND SUMMARY OF THE INVENTION

The present invention relates to a firearm with a firing lever of the short hand type, which combines the advantages of a convenient size and of light weight, which with regard to its use insures required safety and is extremely easy to handle, which is of special advantage because it is suitable for effectively warding off an attack with a speed that cannot be obtained with comparable weapons. With the firearm of the invention it is possible to fire two shots, one after the other, by merely continuously pressing the firing lever, the construction of which is an essential characteristic of this invention.

In addition to the mentioned advantages, special ammunition is used which, however, can be made without great expense, in which case two calibers are provided for the bullet and the shell case, similar to the cartridges presently used, but of a different size, so that special barrels are required.

The firearm has a casing with two barrels that are parallel to each other. Various parts of the casing are connected to the rearward ends of the barrels. A bolt, common to the two can be shifted on a housing or casing along a dovetailed guide. On the inside of the bolt are two firing pins which have stops of different lengths which press against a firing pin guard formed by the rear end of the firing lever, which when in the non-firing position prevents the firing pins from jumping forward.

The firing lever, which can be swivelled around a shaft located near the firing pin guard, so that a larger lever arm is available for the trigger, can only be activated after prior pressing-in of a safety stop, which otherwise hinders its operation. After the pressing-in of the safety stop, the firing lever can be pressed into the inside of the casing, during which movement the firing pin guard consecutively releases both firing pins.

During the movement of the firing lever, which starts from a fixed position, which is realized by a catch, the firing lever reaches a center position that corresponds to the position for the first shot, in which case such center position is realized by means of another catch. The catches expediently consist of a simple device with one or several members which are urged outwardly by spring tension so that they can interact with recesses in the casing.

BRIEF DESCRIPTION OF THE DRAWINGS

In the following, an embodiment of the invention will be explained with reference to the accompanying drawings, wherein.

DETAILED DESCRIPTION OF THE INVENTION

The firearm has two parallel barrels 1 which are connected with a casing 13, for example, formed as a single member, which receives a firing lever 7 and limits its movement.

Figure 5:
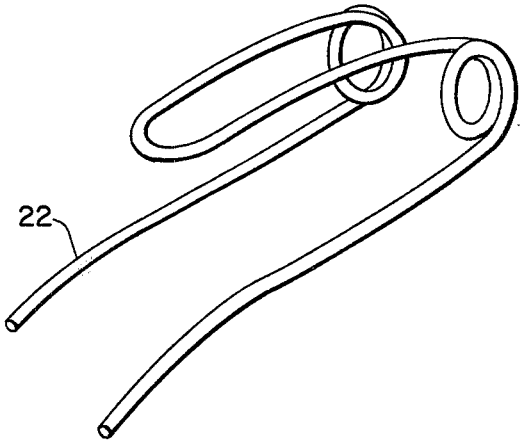
FIG. 5 is a perspective view of a spring of the firearm.

The casing 13 consists of two side parts which are parallel to and connected with each other, so that there is a U-shaped cross-section which is connected with the two barrels 1. The firing lever 7, which is arranged on the inside of the casing 13, takes up consecutive trigger positions against the effect of a spring 22 shown in enlarged form in FIG. 5, while lever 7 is moved in the direction of and toward a contour or recessed portion 9 of the casing 13. Movement of lever 7 toward contour 9 causes a safety stop 8 to abut contour 9, provided stop 8 has not been pressed inwardly of lever 7 such that it fits into the inside of the casing 13.

Figure 4:
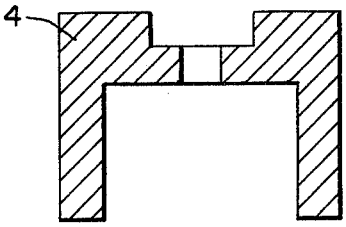
FIG. 4 is a section through a safety bolt of the firearm.

The casing 13 includes a housing or casing 5 which has a lock 4, shown in enlarged form in FIG. 4, for a bolt 2 which is longitudinally moveable with regard to the casing 5, e.g., by means of a dovetailed guide.

Two firing pins 16, 25 are located inside the bolt 2 in such a way that their axes form extensions of the two barrels, which are of the caliber of the bullet of a particular ammunition 14 and the borings of which are adapted to the profile of the ammunition used in the present firearm. Regarding the ammunition, as a special embodiment, the shell has a slightly larger caliber than the bullet.

The firing pins, the right one 16 and the left one 25, are hollow members into the inside of which extend respective tension springs 19, which, in each case, are clamped between the closed end of the respective firing pin and the rear wall 3 of the bolt 2. The firing pins have stops 17, 18 of different lengths, so that they are released when a firing pin guard 15 formed with the firing lever 7 has taken up certain varying positions during the movement of the firing lever around a swivel axis 6.

Figure 1:
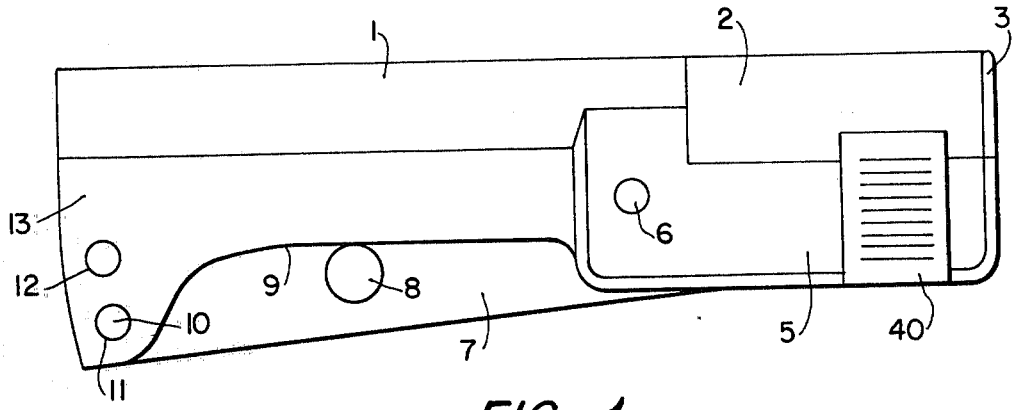
FIG. 1 is a side view of a firearm according to the invention.
Figure 2:
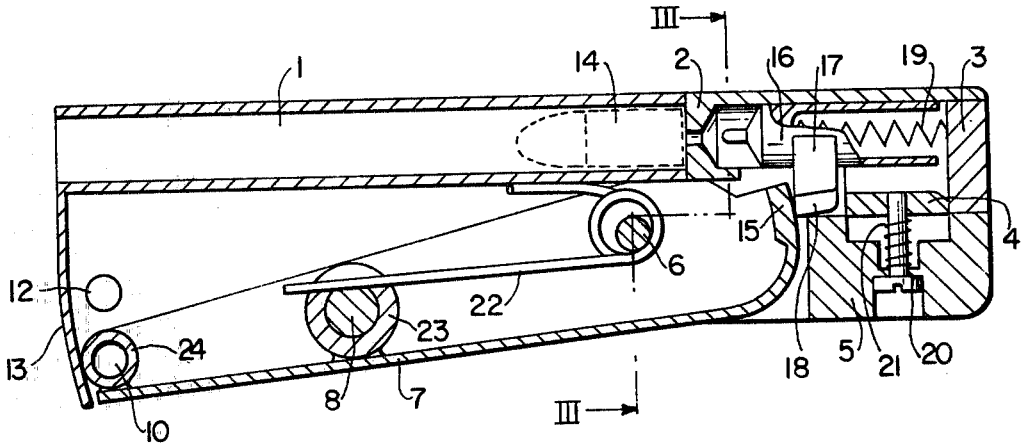
FIG. 2 is a longitudinal section through the firearm, taken along lines II—II of FIG. 3.
Figure 3:
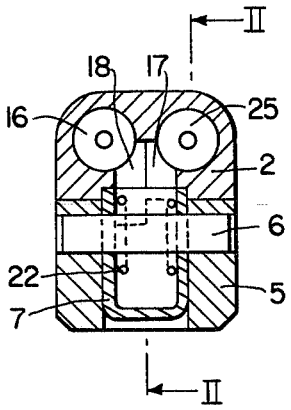
FIG. 3 is a transverse section through the firearm, taken along lines III—III of FIG. 2.

The lock 4 in the casing 5 is mounted on a screw 20 around which a spring 21 is mounted, spring 21 is compressed between the lock 4 and the casing 5. In the extended condition of the spring 21, the lock 4 is located in a hollow space on the inside of the bolt 2, as shown in FIGS. 1 and 2, in which case the bolt lock is set in a completely bolted, i.e. ready-to-fire, position. The releasing of the bolt takes place by the lock 4 being pulled out, e.g. by unscrewing screw 20, or by a member 40 connected with the lock 4 being pulled out.

Adjacent the front end of the firing lever 7, there are provided recesses on both sides in the casing 13. An outwardly urged member 10, fitted in a tube 24 attached to lever 7, sequentially fits into casing 13, at two different positions of lever 7, i.e., first in the secured position thereof and secondly in a position after the first shot.

The safety stop 8 is in the form of a rod which, on its circumference has several flat grooves, into which opposite ends of a spring 22 (FIG. 5) extend, which rest on a bearing part 23 for the safety stop 8. By pressing in the safety stop 8 such that it no longer protrudes, activation of the firing lever 7 is made possible.

The bolt and firing mechanism includes the actual bolt 2 with two firing pins 16, 25 which are arranged coaxially to the barrels. The firing lever 7 can be operated against the resistance of the spring 22, which is wound around a swiveling axis 6, around which the firing lever can be swiveled. The upper ends of the spring rest against the bottom side of the two barrels, and as mentioned above the lower ends of the spring 22 rest on the safety stop 8 or the bearing part 23.

Within the concept of the present invention, the discussed firearm may also have a different form, size, or material composition, in each case adapted to the manufacturing method or application. Instead of the spring made of bent wires, a flat spring may be employed. Instead of a safety stop 8 in the form of a rod, two such rods may be provided on opposite sides of the lever. The same is true for the member 10 on the front end of the firing lever, which may be provided on one or on both sides of the lever. The stop 4 at the end of the screw 20 on the inside of the bolt 2 or the casing 5 may have any form, provided that in the locked position it rests with its peripheral area exactly on the inside surface of the hollow space in the bolt, and that in its unlocked position it is completely received in the inside of the casing 5 below the bolt 2, so that the bolt can be pulled away, along guides, from the barrels for the purpose of reloading.

We claim:

1. A double barrel firearm comprising:

first and second parallel barrels having attached thereto a casing including a pair of parallel spaced arms;

a firing lever pivotable about a bearing extending between said spaced arms from a first non-firing position to second firing positions successively inwardly of said casing;

a bolt slidably mounted on said casing at a location rearwardly of said barrels;

said bolt having first and second firing pins aligned with said first and second barrels, respectively;

said first and second firing pins having extending therefrom respective first and second stops of different lengths;

means for urging said first and second firing pins toward said first and second barrels, respectively;

said firing lever having a first end having guard means for, when said firing lever is in said first non-firing position, acting on said first and second stops to maintain said first and second firing pins spaced from said first and second barrels, respectively, against the force of said urging means, and for, when said firing lever is sequentially moved to said second firing positions, sequentially releasing said first and second stops and thereby allowing said urging means to sequentially drive said first and second firing pins toward said first and second barrels, respectively;

lock means for locking said bolt to said casing; and safety stop means in said firing lever for selectively preventing said firing lever from being moved from said first non-firing position thereof to said second firing positions thereof.

2. A firearm as claimed in claim 1, wherein said bolt is slidable between a first closed position adjacent said barrels and a second open position spaced from said barrels, and said lock means is movable between a first position extending into said bolt and preventing sliding thereof and a second position within said casing and allowing sliding movement of said bolt.

3. A firearm as claimed in claim 1, wherein said safety stop means comprises a rod slidably mounted within said firing lever for movement between a first position abutting said casing and preventing movement of said firing lever from said first position thereof to said second positions thereof, and a second position within said firing lever and allowing movement of said firing lever from said first to said second positions thereof.

4. A firearm as claimed in claim 1, further comprising catch means adjacent a second end of said firing lever for temporarily retarding movement of said firing lever from said first non-firing position thereof to a first of said second firing positions thereof, and for temporarily retarding movement of said firing lever from said first of said second firing positions thereof to a second of said second firing positions thereof.

5. A firearm as claimed in claim 4, wherein said catch means comprises first and second recess in at least one of said parallel spaced arms of said casing and at least one member mounted in said firing lever and urged outwardly therefrom at a position to successively temporarily catch in said first and second recesses.

* * * * *